US005820155A

United States Patent [19]

Brisco

[11] Patent Number: 5,820,155

[45] Date of Patent: Oct. 13, 1998

[54] STEP-IN BINDING SYSTEM FOR RETRO-FITTING TO A SNOWBOARD BOOT BINDER

[76] Inventor: Don L. Brisco, 770 The City Dr., Suite 3500, Orange, Calif. 92668

[21] Appl. No.: 675,944

[22] Filed: Jul. 5, 1996

[51] Int. Cl.[6] ..... A63C 9/00

[52] U.S. Cl. ..... 280/607; 280/618; 280/14.2

[58] Field of Search ..... 280/613, 614, 280/616, 617, 618, 14.2, 607

[56] References Cited

U.S. PATENT DOCUMENTS

| | | | |
|---|---|---|---|
| 4,964,649 | 10/1990 | Chamberlin . | |
| 5,044,654 | 9/1991 | Mezer | 280/14.2 |
| 5,236,216 | 8/1993 | Ratzek . | |
| 5,261,689 | 11/1993 | Carpenter et al. . | |
| 5,354,088 | 10/1994 | Vetter et al. . | |
| 5,362,087 | 11/1994 | Agid . | |
| 5,544,909 | 8/1996 | Laughlin et al. | 280/14.2 |
| 5,548,492 | 8/1996 | Fardie | 280/14.2 |
| 5,667,237 | 9/1997 | Lauer | 280/14.2 |

*Primary Examiner*—Richard M. Camby
*Attorney, Agent, or Firm*—John P. Costello

[57] ABSTRACT

A step-in binding system for retrofitting to snowboard boot binder comprising an adaptor for coupling to a boot binder, and a rotatable, step-in, binding for receiving and engaging to the adaptor. The adaptor incorporates a manual quick-release mechanism for releasing from the step-in binding. An electro-mechanical quick-release mechanism operable through and RF transmitter-receiver combination, is coupled to the step-in binding and serves as a secondary quick-release mechanism. The adaptor is presented in two different embodiments, both of which can be readily retro-fitted to snowboard boot binders in popular use.

13 Claims, 6 Drawing Sheets

STEP-IN BINDING SYSTEM FOR RETRO-FITTING TO A SNOWBOARD BOOT BINDER

BACKGROUND OF THE INVENTION

1. Field of the Invention

This invention pertains to snow boards and snow boarding and, more specifically, to a step-in, rotatable, quick-release, snow board binding system, which can be universally fitted to different snowboards and which can be retro-fitted to existing popular boot binders.

2. Description of the Background Art

The sport of snowboarding has arisen as a popular winter sport alternative to traditional skiing, and this rise in popularity has created a new sports phenomenon. Snowboarding is a fast paced, speed-driven, sport, and as such, common injuries such as bruises, or broken legs, have become part of the risks inherent in snowboarding as well. Additionally, in snow boarding, a high incidence of suffocation deaths have resulted due to snow boarders incurring accidents in deep powder. These deaths result when a snowboarder, propelled under high speed, crashes head first into several feet of deep powder snow, and becomes entombed. Suffocation can subsequently occur when the snowboarder attempts to extricate himself from his predicament and cannot gain access to his bindings to free himself.

This problem is most prevalent with traditional "boot binder" snowboard bindings of the type seen in U.S. Pat. No. 5,356,170, issued Oct. 18, 1994, which are comprised of a plastic shell, closeable over the snow boarder's boots, using a system of straps and buckles; this plastic shell being stationarily mounted to the snowboard. To release this binding, the snowboarder must reach down to release the straps, a task which is nearly impossible if the snowboarder is entombed in snow, which points out a safety deficiency of the boot binder design.

U.S. Pat. No. 5,362,087 issued Nov. 8, 1994, presents a snowboard release binding having both manual and electronically operated releases, which solve the problem of accessibility to the bindings, during entombment in snow. This patent discloses a manual release cable within easy reach of the snowboarder, for releasing the bindings, and a backup radio transmitter wearable on the snowboarder's wrist for alternatively releasing the bindings. However, the binding disclosed in the '087 patent employs an odd design not widely known in the snowboarding industry, and would require snowboarders to purchase an entirely different style of equipment than they currently own, resulting in added expense.

Therefore, it would be desirable for a quick-release, step-in binding, to be able to retro-fit to currently popular boot binder designs. A boot binder incorporating a step-in binding having an accessible quick-release feature, would add a measure of safety not present in contemporary boot binder design.

Additionally, for added snowboarding performance, it has been found to be desirable to incorporate a feature into the bindings which allow the snowboarder to select the positioning of the feet. Different snowboarders prefer different foot positionings to accomplish different trick, or freestyle, maneuvers. U.S. Pat. No. 5,236,216 issued Aug. 17, 1993 and U.S. Pat. No. 5,354,088 issued Oct. 11, 1994 are believed to be representative of the state of the prior art with regards to rotatable snowboard bindings. These patents teach rotatable bindings which are difficult to use, due to their mechanical complexity.

A need therefore exists for an easily accessible, rotatable, quick-release, snowboard binding system which can be retrofitted to commonly used boot binders, thereby allowing a snowboarder the freedom to easily escape from snowdrifts, or holes, present in deep powder.

The foregoing patents reflect the state of the art of which the inventor is aware and are tendered with a view toward discharging the inventor's acknowledged duty of candor in disclosing information which may be pertinent to the examination of this invention. It is respectfully stipulated, however, that none of these patents teach or render obvious, singly or when considered in combination, the inventor's claimed invention.

SUMMARY OF THE INVENTION

The present invention pertains to a rotatable, step-in, quick-release binding system for snowboards, which can be retro-fitted to traditional boot binders currently in popular use. This binding system incorporates a step-in binding feature and two different means for quickly releasing the boot binder from the binding, these quick-release means being accessible to the snowboarder from any body position, or predicament. This snowboard binding system can also be universally fitted to snowboards produced by any manufacturer.

The rotatable component of this invention comprises a rotatable base plate which encircles a stationary coupling disc. The stationary coupling disc is made into a universal fitting member by the placement in its surface of a plurality of radially-arranged, through-slots, and through holes. Any fastener pattern or bolting pattern favored by a particular manufacturer, is expected to conform to this myriad of through-slots and through-holes.

The rotatable base plate encircles and rotates around the stationary coupling disc, and an automatic locking means is coupled to, and rotates with, the rotatable base plate. When a desired foot angle is reached, the automatic locking means is engaged, thereby holding the rotatable base plate fast to the stationary coupling disc.

The rotatable base plate is coupled to a step-in binding comprised of a front engaging member and a heel engaging member. The front engaging member is for engaging the front portion of an adaptor retro-fitted to the boot binder, and the heel engaging member is for engaging and locking the rear of the adaptor into place.

The adaptor, which is retro-fitted to the boot binder, is presented in two embodiments, the first embodiment being a "snowclaw" adaptor plate, and the second embodiment being a solid member, both of which couple with the front engaging member and heel engaging member of the step-in binding. In both embodiments, a manual quick-release means is built into the adaptor. As an added feature, this system can also include a second, electro-mechanical quick-release means, which is actuated by an RF receiver-transmitter combination. The incorporation of the electro-mechanical quick-release means provides the snowboarder with a secondary means of escape from his bindings.

Additionally, while the two embodiments of the adaptor are primarily designed as a retro-fit for a traditional boot binder, it is within the scope of this invention to incorporate the adaptors integrally into a hard, or soft, snowboarding boot.

Consequently, this invention intends to accomplish the following objects and advantages:

An object of the invention is to provide a snowboard binding system which retro-fits to existing boot binders, and allows snowboarders to quickly exit their bindings, from any body position, or predicament.

Another object of the invention is to provide a retro-fit snowboard binding system for boot binders having a dual quick-release means.

Still another object of the invention is to provide a retro-fit snowboard binding system for boot binders that is adjustable to any desired foot angle.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
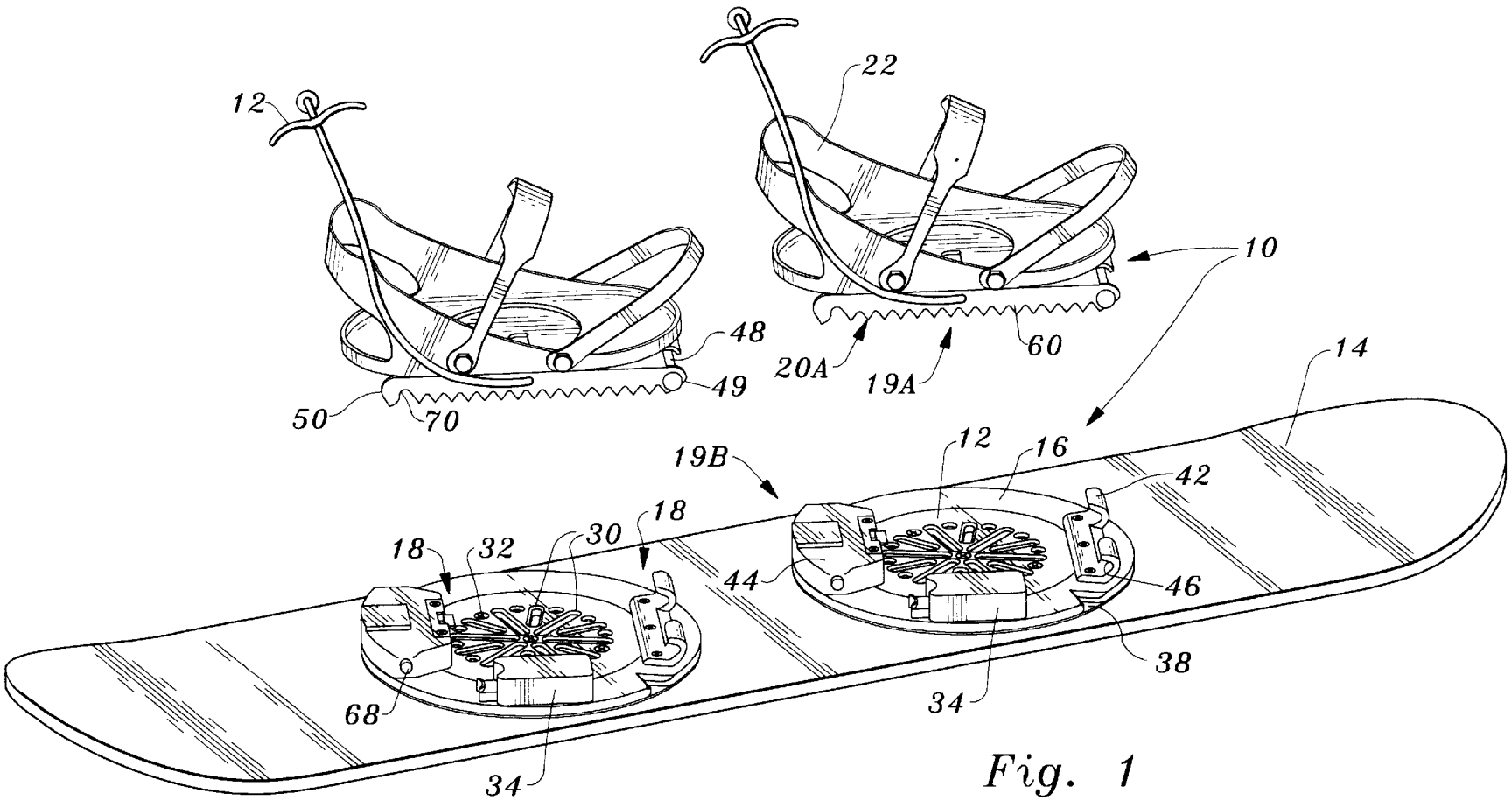
FIG. 1 is an elevated perspective view showing a preferred embodiment of the step-in binding system with the boot binder and snowclaw adaptor detached from the step-in binding.

Referring more specifically to the drawings, the present invention is represented by the snowboard binding system 10 generally shown in FIG. 1. Binding system 10 is primarily comprised of a stationary coupling disc 12 for coupling the system to a snowboard 14, a rotatable base plate 16, a step-in binding 18 coupled to the rotatable base plate 16, two quick-release means 19A, 19B which may be individually or dually incorporated into the binding system, and boot binder adaptor 20A.

Figure 9:
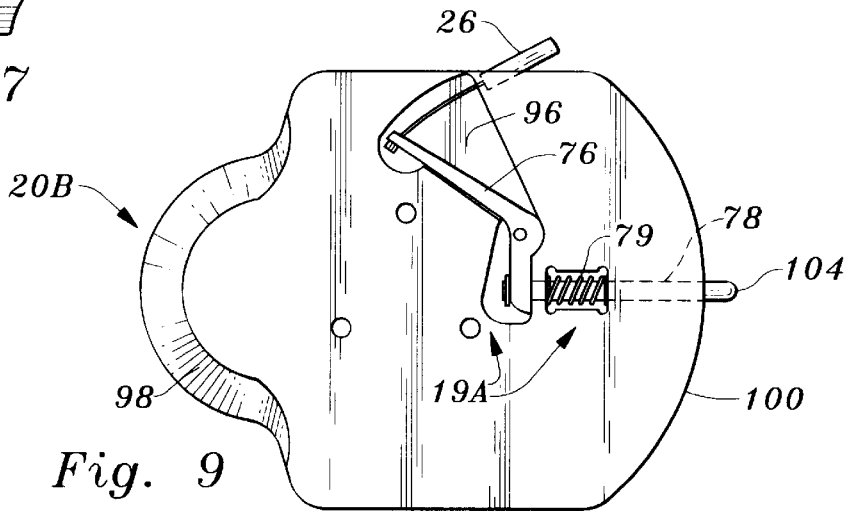
FIG. 9 a plan view of the solid member adaptor embodiment of the step-in binding system.

The first and preferred embodiment of adaptor 20A is represented by a plate having downward depending serrated edges and is designated herein as the "snowclaw adaptor". The second embodiment 20B, shown for the first time in FIG. 9, is a solid member and is designated herein as the "solid member adaptor." Depending on which adaptor is employed, minor modifications to binding system 10 must be made. It will be further appreciated that binding system 10 may vary as to the configuration and details of its parts without departing from the basic concepts as disclosed herein.

Figure 2:
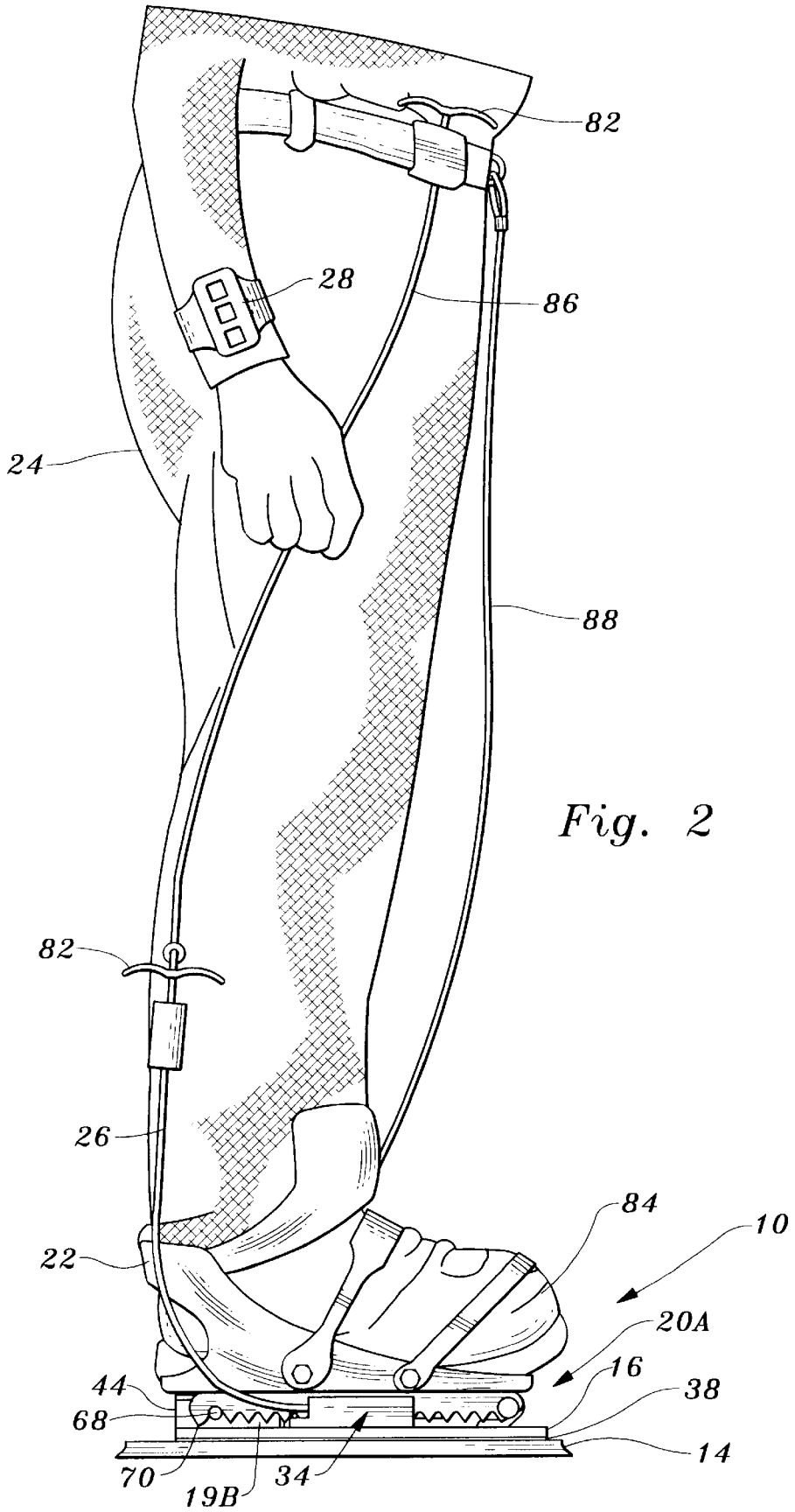
FIG. 2 is a side perspective view of the preferred embodiment of the step-in binding system showing a snowboarder positioned in the binding system, having both manual and electro-mechanical quick-release means readily accessible.

FIG. 2 shows binding system 10 with the preferred snowclaw adaptor 20A coupled to a boot binder 22 with a snowboarder 24 positioned therein. This view illustrates the entire system in use, and shows both a cable 26 coupled to the manual quick-release means 19A (located beneath snowclaw adaptor 20A) and an RF transmitter 28 for actuating the electro-mechanical quick-release means 19B, both positioned for easy access by the snowboarder 24.

Figure 3:
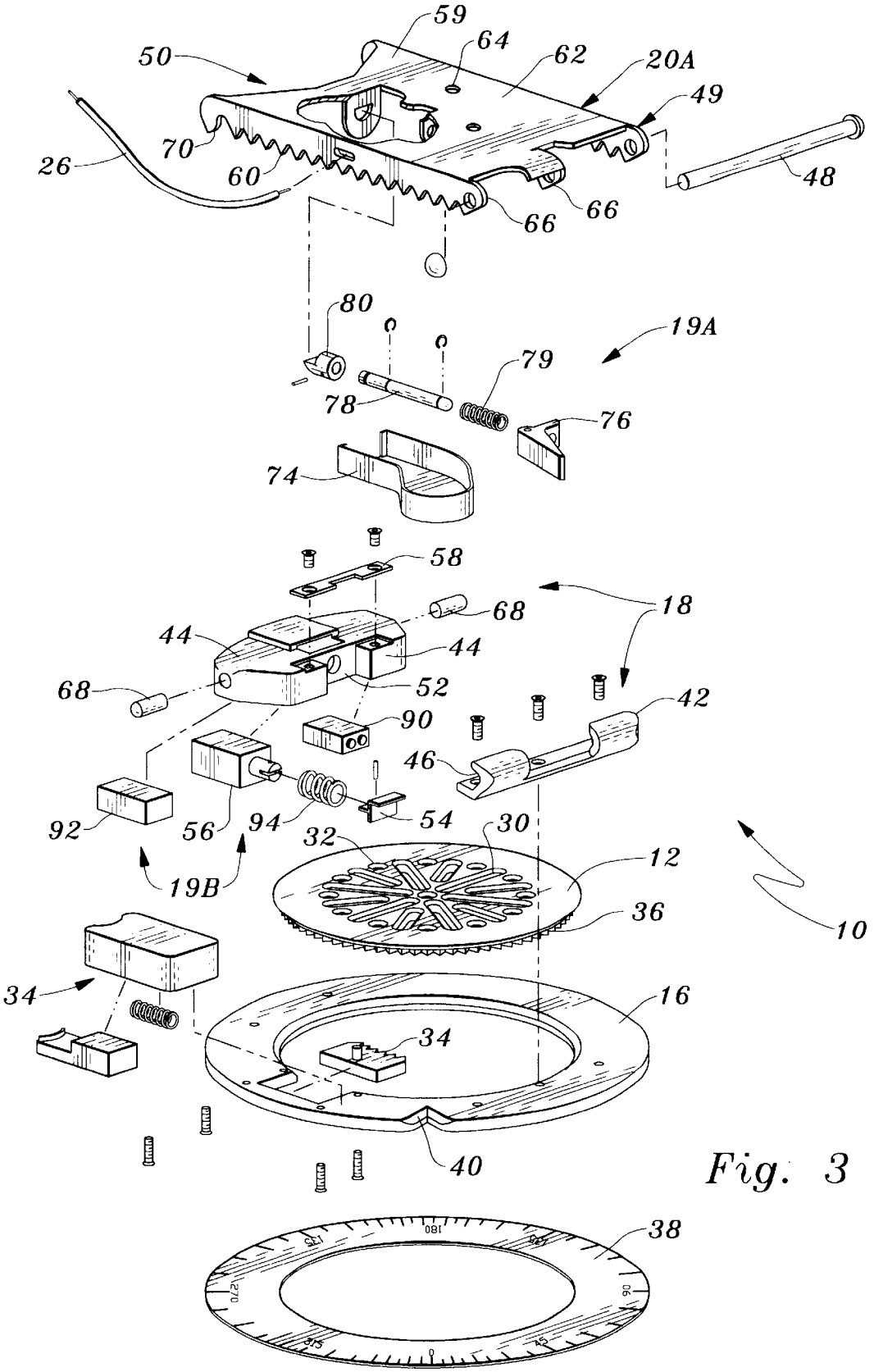
FIG. 3 is an exploded view of the preferred embodiment of the step-in binding system.
Figure 4:
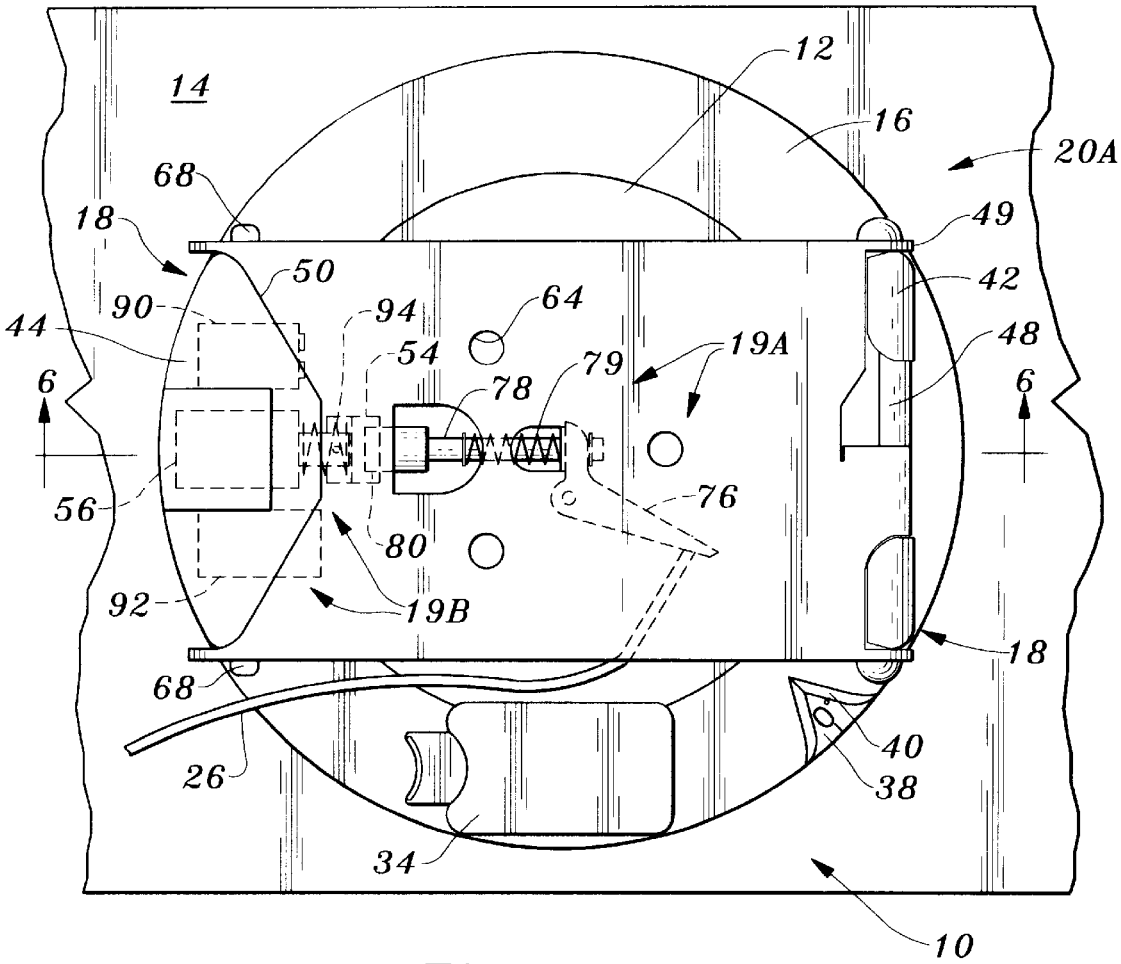
FIG. 4 is a plan view of the preferred embodiment of the step-in binding system, showing the snowclaw adaptor coupled to the step-in binding system.
Figure 5:
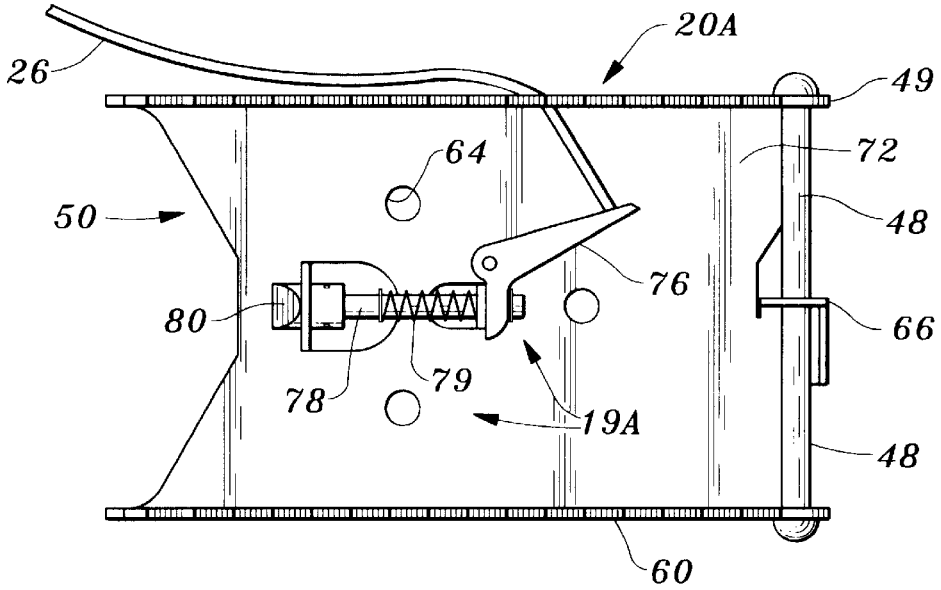
FIG. 5 is a bottom view of the snowclaw adaptor component of the step-in binding system, showing the mechanical quick release means uncovered for viewing.
Figure 6:
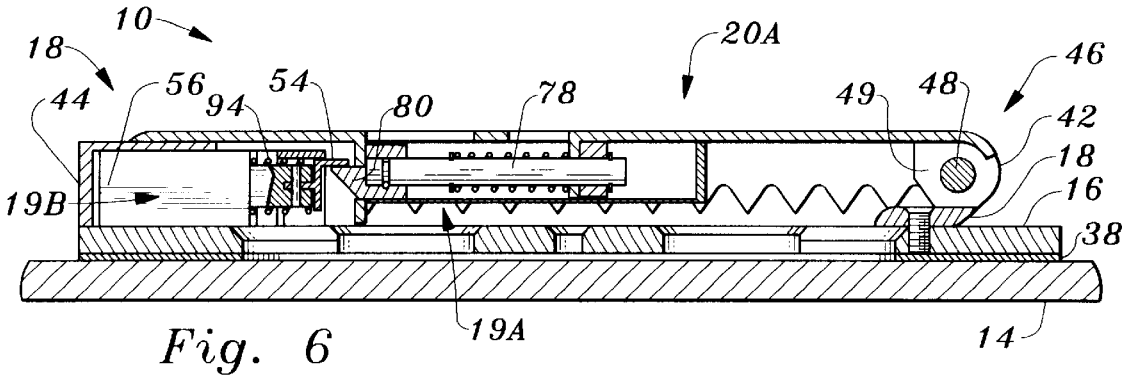
FIG. 6 is a side cutaway view of the preferred embodiment of the step-in binding system with the snowclaw adaptor coupled thereto.

FIG. 3 is an exploded view of the preferred snowclaw adaptor embodiment, and FIGS. 4–6 represent different views of this preferred embodiment, illustrating all relevant components of the invention.

Binding system 10 is coupled to a snowboard 14 with stationary coupling disc 12. Stationary coupling disc 12 is designed to accommodate the fastening or bolting patterns of a variety of snowboard manufacturers, and to these ends, a plurality of through-slots 30 and through-holes 32 penetrate the surface of stationary coupling disc 12. Through-slots 30 are positioned radially upon stationary coupling disc 12, and through-holes 32 are positioned at regular strategic intervals. It has been found that such a pattern of arrangement of through-slots 30 and through-holes 32 is most conducive to universally accommodating the widest range of fastening or bolting patterns.

As seen in FIGS. 3 and 4, rotatable base plate 16 encircles and rotates around stationary coupling disc 12. An automatic locking means 34 is coupled to, and rotates with, rotatable base plate 16. An "automatic locking means" defined for purposes of this invention would be any locking means known in the art which passively imparts a pound force sufficient for holding rotatable base plate 16 immovably to stationary coupling disc 12 during normal use. The passive nature of automatic locking means 34 relieves the snowboarder from the responsibility of having to remember to lock rotatable base plate 16 to stationary coupling disc 12, upon reaching a desired angle for positioning the feet.

This passive automatic locking means 34 engages, regardless of the snowboarder's active involvement. Automatic locking means 34 imparts an added measure of safety to binding system 10, which reduces the likelihood that a snowboarder will have an accident resulting from rotatable base plate 16 moving during a crucial maneuver. Stationary coupling disc 12 has a plurality of gear teeth 36, or similar means, cut into its outer edge, which provides a surface for engaging with automatic locking means 34. In this manner, rotatable base plate 16 is held fast to stationary coupling disc 12.

Upon releasing automatic locking means 34, rotatable base plate 16 can be rotated to any desired foot positioning. A thin protractor plate 38 is positioned beneath rotatable base plate 16, having graduations in 5 degree increments. A window 40 imparted into the outer edge of rotatable base plate 16 allows the graduations on protractor plate to be viewed. This arrangement of base plate 16, with protractor plate 40, allows a snow boarder to rotate base plate 16, and lock it at a favored foot positioning, determined by stopping base plate 16 at a desired 5 degree increment.

Referring additionally to FIG. 6, it can be seen that step-in binding 18 is coupled to rotatable base plate 16, and is generally comprised of a front engaging member 42 and a heel engaging member 44. Front engaging member 42 is further comprised of an overlapping edge 46 for overlapping transverse rod 48 located in front portion 49 of snowclaw adaptor 20A. Heel engaging member 44 is shaped to conform with the shape of rear portion 50 of snowclaw adaptor 20A. The front of heel engaging member 44 includes a receiving bay 52 for receiving latch plate 54 which is coupled to solenoid 56, of electro-mechanical quick-release means 19B. Horizontal plate cover 58 prevents snow and moisture from inundating receiving bay 52, and affecting the ability of latch plate 54 to retract into receiving bay 52 upon actuation of solenoid 56.

Referring again to FIG. 3, the preferred snowclaw adaptor 20A is shown as a plate member 59 having continuous and downwardly depending serrated side edges 60. Serrated side edges 60 provide a means of traction upon snow and ice-laden surfaces. Top surface 62 of plate member 59 includes a plurality of holes 64 imparted therein for aligning with similar holes in the bottom of boot binder 22, and coupling thereto in a flush manner, using bolts, rivets, or similar fastening means.

Snowclaw adaptor 20A further includes a front portion 49 comprised of three support points 66 which surroundingly support transverse rod 48. Transverse rod 48 spans front portion 49, and acts as an underlapping member for engaging with the overlapping edges 46 of front engaging member 42. Hence, transverse rod 48 acts as a means for guiding front portion 49 of snowclaw adaptor 20A into proper placement with front engaging member 42 of step-in binding 18.

Rear portion 50 of snowclaw adaptor 20A is guided into heel engaging member 44 by two pins 68 protruding transversely from the side of heel engaging member 44. Pins 68 preferably engage with the highest point of rear-most serration 70 as seen in FIG. 2.

Referring to FIGS. 3, 4 and 5, manual quick-release means 19A can be closely examined. Manual quick-release means 19A is coupled to the bottom surface 72 of snowclaw adaptor 20A, and is preferably protected from the elements by cover 74. Manual quick-release means 19A is comprised of a compact lever arm 76 having a first end coupled to cable 26, and a second end coupled to retractable latch pin 78, wherein latch pin 78 is biased by spring 79. Latch pin 78 includes a beveled striker 80 coupled to an end opposite of lever arm 76 for engaging with latch plate 54. The beveled area of striker 80 causes latch pin 78 to slide forward on its own, upon contacting latch plate 54, and being forced downward by a snowboarder stepping into step-in binding 18. When in place, striker 80 underlaps latch plate 54, thereby holding snowclaw adaptor 20A and boot binder 22 fully, and firmly, within step-in binding 18.

Manual quick-release means 19A is actuated by cable 26 coupled to a "T"-handle 82 as is seen most clearly in FIG. 2. FIGS. 4 and 5 show how cable 26 pulls lever arm 76, which causes latch pin 78 to move forward, pulling striker 80 out from beneath latch plate 54, thereby freeing snowclaw adaptor 20A from step-in binding 18. T-handle 82 may be positioned slightly above the snowboarder's boot 84, or else have a cable extension 86 for positioning upon the snowboarder's belt, for easy access, from any position. Cable extensions 86 could be sewn to the snowboarder's pants, or else could be threaded through a special elastic tube incorporated into the snowboarder's pants, specifically for the purpose of containing cable extensions 86. Therefore, if a snowboarder is buried under a snowdrift, T-handles 82 present prominent, and readily identifiable pulling handles, from which a snowboarder could access, and escape from step-in bindings 18.

Additionally, as seen in FIG. 2, a lanyard 88 could be added to the system 10 for coupling to a snowboarder's belt and to the snowboard 14. Lanyard 88 would act as a safety escape means which the snowboarder could use to grasp, and pull himself out of entombment in a snow bank, upon releasing from step-in bindings 18.

As shown clearly in FIGS. 2, 3 and 4, heel engaging member 44 incorporates electro-mechanical quick-release means 19B. Electro-mechanical quick-release means 19B is comprised of latch plate 54, solenoid 56, a battery 90, an RF receiver 92, and RF transmitter 28. RF transmitter 28 sends a signal to RF receiver 92, which in turn actuates solenoid 56, which slidably retracts latch plate 54, backward, and free of striker 80. Solenoid 56 is biased by spring 94 for returning latch plate 54 to its resting position. Following actuation, the snowboarder lifts his foot, and releases snowclaw adaptor 20A from step-in binding 18. Hence, with manual quick-release means 19A, it is striker 80 being pulled free of latch plate 54 which releases snowclaw adaptor 20A, and conversely, with electro-mechanical quick-release means 19B, latch plate 54 is pulled free of striker 80, which likewise, releases snowclaw adaptor 20A. By incorporating both manual and electro-mechanical quick-release means into the invention, the snowboarder is presented with two reliable means for safely exiting his bindings from any position, or predicament.

RF transmitter 28 and RF receiver 92 will preferably present the snowboarder with the option of individually actuating the solenoid 56 on the left foot, or the right foot, as well as actuating both solenoids 56 for simultaneously, exiting both feet from the bindings. These selective actuations of solenoids 56 can be accomplished through means and methods well know in the electrical arts.

Figure 7:
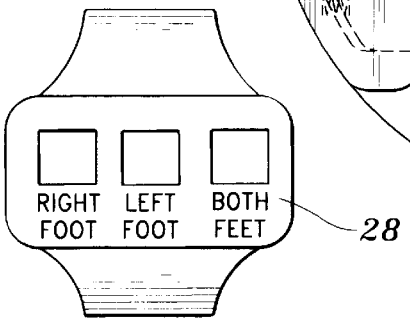
FIG. 7 is closeup view of the RF transmitter component of the electro-mechanical quick-release means.

FIG. 7 is closeup view of the RF transmitter component of the electro-mechanical quick-release means and illustrates how RF transmitter 28 might appear to accomplish these tasks.

Figure 8:
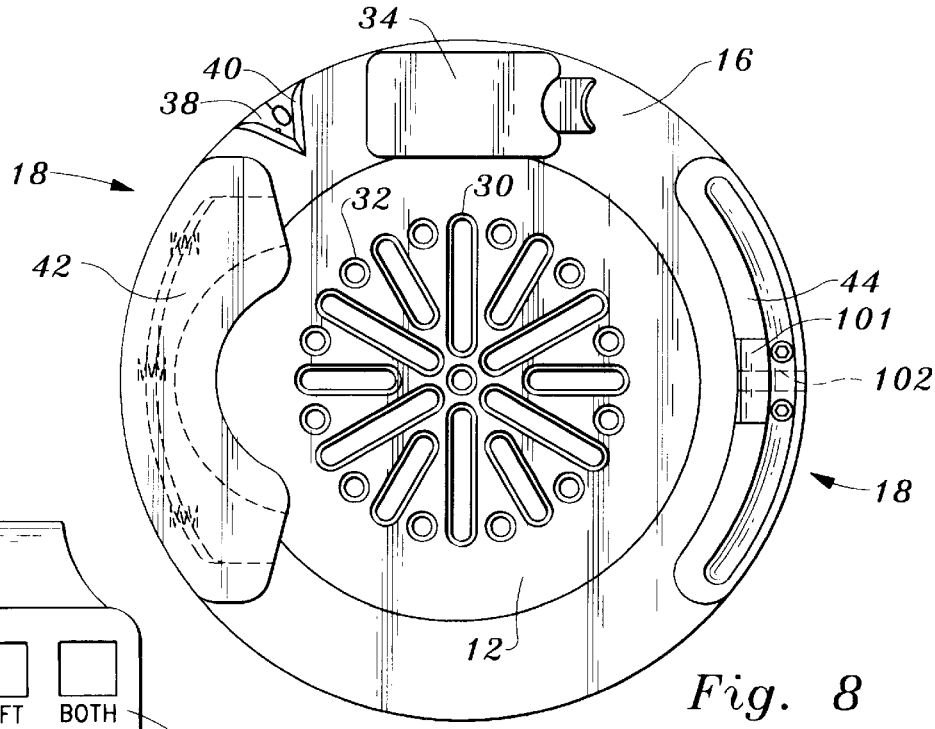
FIG. 8 is a plan view of the step-in binding system for the solid member adaptor.
Figure 10:
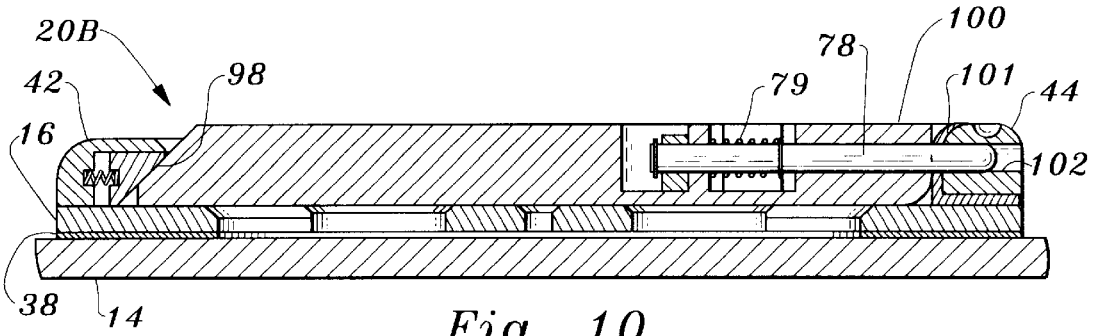
FIG. 10 is a side cutaway view of the solid member adaptor embodiment coupled to the step-in binding system.

Referring now to FIGS. 8, 9, and 10, the solid member adaptor embodiment is shown. Solid member adaptor 20B is preferably constructed from a hard polycarbonate material which has a cavity 96 for housing manual quick-release means 19A. A plate cover couples over cavity 96, and protects manual quick-release means 19A from the elements. Although not shown, solid member adaptor 20B can have treads imparted into its bottom surface, for traction. FIGS. 8, 9 and 10 show binding system 10 with the manual quick-release means 19A only, but it is within the scope of this invention to incorporate electro-mechanical quick-release means 19B into this embodiment as well. Likewise, the snowclaw adaptor 20A embodiment could incorporate solely mechanical quick-release means 19A.

Solid member adaptor 20B includes a front arcuate toe-in area 98 for engaging with an arcuate front engaging member 42 of step-in binding 18, and a rear portion 100, for facing against heel engaging member 44 of step-in binding 18. A small, curved biasing plate 101 is preferably coupled to front face of heel engaging member 44 for purposes of receiving rear portion 100 and properly aligning latch pin 78 with a cavity 102 imparted into the face of heel engaging member 44. Biasing plate 101 includes a slot aligned with cavity 102 for slidably receiving latch pin 78. Latch pin 78 preferably has a rounded off end 104 for easy engagement into cavity 102. Upon placing solid member 20B into step-in binding 18, a similar positive engagement, as with the snowclaw adaptor 20A, is experienced.

Figure 11A:
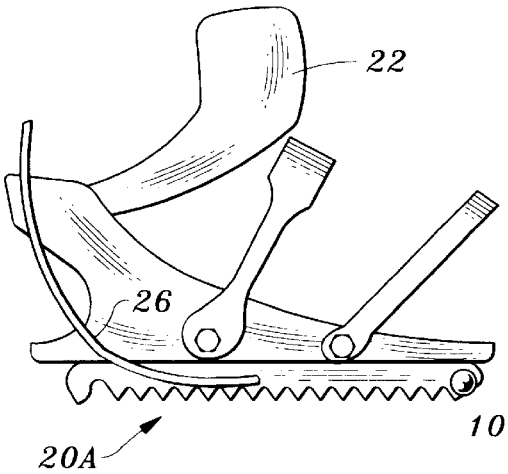
FIG. 11A is a side view showing the snowclaw adaptor coupled to a boot binder.
Figure 11B:
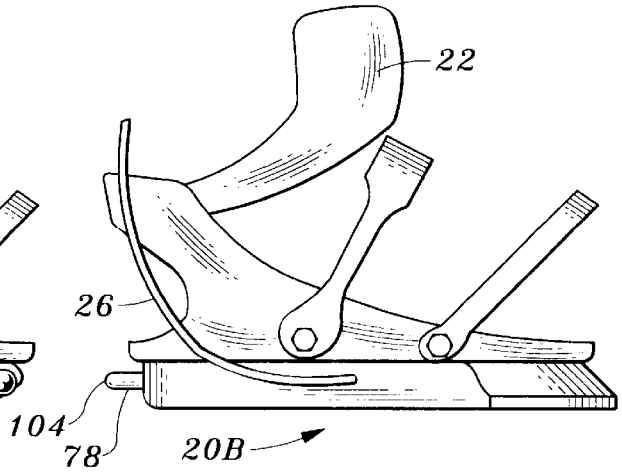
FIG. 11B is a side view showing the solid member adaptor coupled to a boot binder.

The snowclaw and solid member adaptors can be incorporated into several variations of popular snowboarding footwear. FIGS. 11A and 11B show both embodiments incorporated into a boot binder style of footwear popular with many snowboarders. In usage, the boot binder 22 would be removed along with the snowclaw 20A or solid member 20B adaptor, for walking. Boot binders 22 typically have a plurality of holes imparted into their bottoms for affixing to a snowboard. These same holes would be used to couple to the snowclaw 20A and solid member 20B adaptors, in a retro-fit fashion. In this manner a boot binder 22 could be converted to a step-in boot, for greater snowboarding convenience and safety.

Figure 12A:
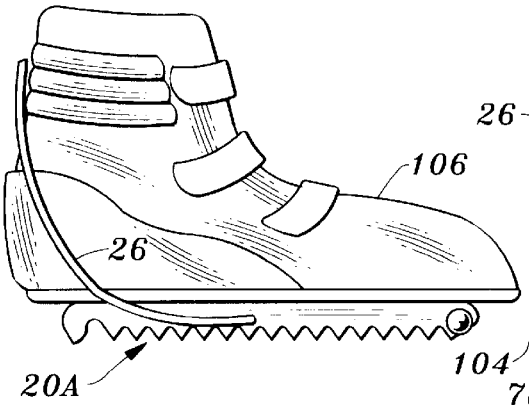
FIG. 12A is a side view showing the snowclaw adaptor incorporated into a snowboarding boot.
Figure 12B:
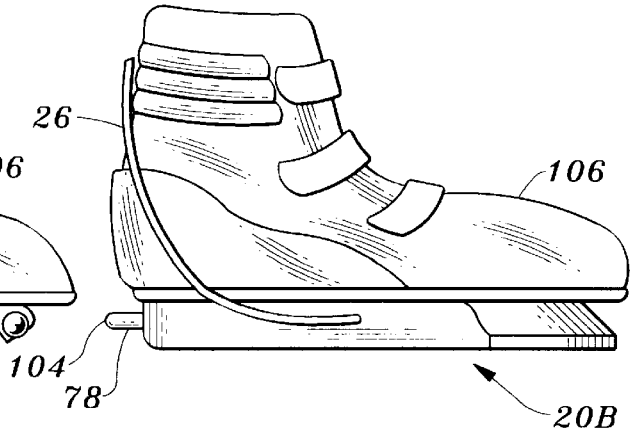
FIG. 12B is a side view showing the solid member adaptor incorporated into a snowboarding boot.

FIGS. 12A and 12B show the snowclaw and solid members incorporated into a boot 106. In this design, the snowclaw 20A and solid members 20B are not retro-fit adaptors, but, instead, are manufactured integrally with boot 106. In this case, boot 106 may be a hard shell type, similar to a ski-boot, or a soft boot, of the type often favored by snowboarders.

Accordingly, it will be seen that this invention provides a quick-release, step-in binding system for retro-fitting to boot binders. This binding system imparts a level of snowboarding safety to boot binders not heretofore seen.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A releasable, step-in, snowboard binding system, the binding system comprising:

A) adaptor means for coupling to a step-in binding, said step-in binding coupled to a rotatable base plate, said rotatable base plate selectively rotatable to a desired degree increment, and held fast with a locking means to a stationary coupling disc, said stationary coupling disc for coupling said binding system to a snowboard;

B) said step-in binding having a front engaging member and a heel engaging member;

C) said front and heel engaging members for engaging said adaptor means; and

D) a manual quick-release means for quickly coupling and uncoupling said adaptor means to and from said step-in binding, said manual quick-release means coupled to said adaptor means.

2. The binding system as recited in claim 1, wherein said adaptor means is a plate member, said plate member having serrated, downward depending side edges, a front portion, and a rear portion, said front and rear portions engaging respectively with said front engaging member and said heel engaging member.

3. The binding system as recited in claim 2, wherein said plate member further comprises a plurality of through-holes imparted therein, said through-holes used for retro-fitting to a boot binder.

4. The binding system as recited in claim 2, wherein said plate member is incorporated into a snowboarding boot.

5. The binding system as recited in claim 1, wherein said adaptor means is a solid member, said solid member having a front portion, and a rear portion, said front and rear portions engaging respectively with said front engaging member and said heel engaging member.

6. The binding system as recited in claim 5, wherein said solid member further comprises a plurality of through-holes imparted therein, said through-holes used for retro-fitting to a boot binder.

7. The binding system as recited in claim 5, wherein said solid member is incorporated into a snowboarding boot.

8. A releasable, step-in, snowboard binding system for retro-fitting to boot binders, the binding system comprising:

A) a plate member, said plate member having serrated, downward depending side edges, a front portion, and a rear portion, a top surface and a bottom surface;

B) said plate member including a plurality of through-holes imparted therein for coupling to a boot binder;

C) a step-in binding having a front engaging member and a heel engaging member, said front and heel engaging members coupled upon a rotatable base plate, said rotatable baseplate encircling a stationary coupling disc;

D) automatic locking means, for locking said rotatable baseplate to said stationary coupling disc;

E) said front portion of said plate member engaging with said front engaging member, said rear portion of said plate member engaging with said heel engaging member; and F) a manual quick-release means for quickly coupling and uncoupling said plate member from said step-in binding, said quick-release means coupled to said bottom surface of said plate member.

9. The binding system as recited in claim 8, wherein said coupling disc further comprises a plurality of radially arranged through-slots imparted therein, said through-slots for coupling said step-in binding system to a snowboard.

10. The binding system as recited in claim 9, wherein said manual quick-release means is coupled to a cable, said cable coupled to a snowboarder's clothing and terminating at a T-handle, said T-handle a distance easily accessible to a snowboarder from any body position.

11. The binding system as recited in claim 10, further comprising an electro-mechanical quick-release means for coupling and uncoupling said plate member from said step-in binding, said electro-mechanical quick-release means actuatable through an RF receiver-transmitter means.

12. A releasable, step-in, snowboard binding system, the binding system comprising:

A) adaptor means comprising front and rear portions for coupling to a step-in binding, said step-in binding coupled to a rotatable base plate, said rotatable base encircling a stationary coupling disc;

B) said rotatable base plate selectively rotatable to a desired degree increment and held fast with a locking means to said stationary coupling disc;

C) a step-in binding having a front engaging member and a heel engaging member, said front and heel engaging members coupled upon said rotatable base plate;

D) said stationary coupling disc including a plurality of radially arranged through-slots imparted into its surface, said through-slots for coupling said step-in binding system to a snowboard;

E) said front portion of said adaptor means engaging with said front engaging member, said rear portion of said adaptor means engaging with said heel engaging member;

F) a manual quick-release means for quickly coupling and uncoupling said adaptor means from said step-in binding, said quick-release means coupled to said adaptor means; and G) an electro-mechanical quick-release means actuatable through an RF receiver-transmitter means, said electro-mechanical quick-release means slidably disengagable from said manual quick-release means.

13. The binding system as recited in claim 12, wherein said manual quick-release means is coupled to a cable, said cable coupled to a snowboarder's clothing and terminating at a T-handle, said T-handle a distance easily accessible to a snowboarder from any body position.

* * * * *